US010563409B1

(12) United States Patent
Simonsen

(10) Patent No.: US 10,563,409 B1
(45) Date of Patent: Feb. 18, 2020

(54) APPARATUS FOR ATTACHING AN INSULATED PANEL TO A FACADE

(71) Applicant: David Simonsen, Redding, CA (US)

(72) Inventor: David Simonsen, Redding, CA (US)

( * ) Notice: Subject to any disclaimer, the term of this patent is extended or adjusted under 35 U.S.C. 154(b) by 0 days.

(21) Appl. No.: 16/125,582

(22) Filed: Sep. 7, 2018

(51) Int. Cl.
*E04F 13/08* (2006.01)

(52) U.S. Cl.
CPC ..... *E04F 13/081* (2013.01); *E04F 13/0814* (2013.01); *E04F 13/0821* (2013.01); *E04F 13/0828* (2013.01); *E04F 13/0841* (2013.01)

(58) Field of Classification Search
CPC ..... E04F 13/0821; E04F 13/0828; E04F 13/0814; E04F 13/081; E04F 13/0841
See application file for complete search history.

(56) References Cited

U.S. PATENT DOCUMENTS 2,073,277 A * 3/1937 Hohl ..... E04C 2/54 52/404.1
4,833,858 A * 5/1989 Hutchison ..... E04B 1/6166 52/475.1
5,263,292 A * 11/1993 Holland ..... E04B 2/92 52/235
5,546,713 A * 8/1996 Voegele, Jr. ..... E04D 3/08 52/202
5,687,524 A * 11/1997 Ting ..... E04B 2/965 52/235
5,893,245 A * 4/1999 Sekiguchi ..... E04F 13/0816 403/295
6,035,598 A * 3/2000 Sukolics ..... E04F 13/081 52/235
6,745,527 B1 * 6/2004 Sherman ..... E04B 2/96 52/235
7,162,842 B2 * 1/2007 Ribic ..... E04B 2/96 52/167.3
7,752,818 B1 * 7/2010 Roegge ..... E04F 13/0814 52/235
8,033,066 B2 * 10/2011 Griffiths ..... E04F 13/081 52/235
10,011,997 B1 * 7/2018 Bilge ..... E04F 13/0733

FOREIGN PATENT DOCUMENTS

DE 19934481 A1 * 2/2001

* cited by examiner

*Primary Examiner* — Adriana Figueroa
(74) *Attorney, Agent, or Firm* — Theodore J. Bielen, Jr.

(57) ABSTRACT

An apparatus for attaching an insulated panel to a facade utilizing a bracket having a platform and an arm, each connected to the insulated panel in separate places. The bracket is locked to the facade and may be formed with thermal breaks between the insulated panel and the facade.

4 Claims, 12 Drawing Sheets

APPARATUS FOR ATTACHING AN INSULATED PANEL TO A FACADE

CROSS-REFERENCES TO RELATED APPLICATIONS

The present application is a continuation of U.S. patent application Ser. No. 15/404,089, which is a Continuation-In-Part of U.S. patent application Ser. No. 15/048,042, filed 19 Feb. 2016, now issued as U.S. Pat. No. 9,903,123 on 27 Feb. 2018.

BACKGROUND OF THE INVENTION

The present invention relates to a novel and useful system for mounting panels to a façade found on building structures and the like.

Panels are often used on residential and commercial buildings to cover walls or facades since they have proved to be economical, protective of the edifice, and exhibit a high degree of design versatility, when compared to other coverings.

In the past, panel systems have been employed that are categorized as "progressive style systems". That is to say, that the panels are installed progressively from left to right on the bottom row of a building façade and then upwardly one row at a time in the same direction. The disadvantage of a progressive style panel system is that if a single panel must be removed, many other panels must also be removed prior to gaining access to such single panel.

In the past, many systems for mounting wall panels to a surface have been proposed. For example, U.S. Pat. No. 6,588,165 shows an extrusion device for mounting a wall panel that utilizes a base having receiver flanges that accept a clip that snaps into a channel and includes arms that extend over the top of the panel.

United States Patent Application Publication 212/0304573 describes a panel clip structure which is attached the backside of the panel and is attached to horizontal joints through a tongue and groove system. A plurality of horizontal caps then keeps a single panel from being easily removed without repositioning adjacent panels on the façade.

United States Patent Application Publication 2006/0080939 features a wall panel system that utilizes a plurality of furring strips that are used to fasten panels via fasteners extending through grooves formed in the panel itself.

U.S. Pat. No. 6,688,056 describes a demountable wall panel system that utilizes vertical posts, a panel covering, a sealing rail, and an articulating floor channel. A support frame is formed and operatively connected to the articulating floor channel, which is used to secure the frame to a ground surface.

U.S. Pat. No. 7,752,818 shows a self-leveling clip which is fixed to the façade and holds a panel by the use of a retentive clip that is engaged by a self-drilling screw between adjacent panels.

An apparatus for mounting a plurality of panels to a façade in a non-progressive manner, efficiently and economically, would be a notable advance in the building industry.

SUMMARY OF THE INVENTION

In accordance with the present application, a novel and useful apparatus for mounting panels to a façade in a non-progressive manner is herein described.

The apparatus of the present application utilizes a base or field extrusion having a plate and first and second flanges extending outwardly from the plate. The first and second flanges form an open channel which extends along the plate. Each of the first and second flanges is formed with a resilient leg that extends inwardly toward the channel. The base is held to the façade by a fixing element such as a plurality of screws, rivets, and the like.

An extension element or frame extrusion is connected to each of the panels to be mounted to the façade. Each extension element is formed with a platform that is supported by the plate of the base. Platforms on adjacent extension elements connected to adjacent panels are positioned apart from one another and away from the faces of the first and second panels.

A fastener is utilized to interconnect adjacent panels. Such fastener is fashioned with a basal portion and first and second arms projecting from the basal portion. The basal portion also is formed with pair of inclined surfaces that are angled relative to the plate. Likewise, the pair of arms extending from the basal portion each includes contact surfaces for engaging the platforms found on the extension elements of adjacent panels. The pair of inclined surfaces of the basal portion of the fastener is dimensioned to slide on a pair of resilient legs of the flanges extending from the plate of the base. Such sliding takes place upon the rotation of the basal portion of the fastener within the channel of the base resulting in a force being exerted on the resilient legs of the flanges. Such force forces the contact surfaces of the pair of arms of the fastener to firmly press downwardly on the platforms of the extension elements connected to adjacent panels and, thus, hold the adjacent panels to the façade.

The extension element may also be formed with a slot such that adjacent extension elements connected to adjacent panels allow the insertion of a strip that essentially occupies the space or reveal between panels. The extension element may also be employed to hold corner brackets between panels.

A stiffener may also be used in adjacent panels and be at least partially supported by a shelf connected to extension elements found in adjacent panels. Stiffeners provide support to the panels in order to prevent deflection and cracking of the panel.

In addition, the extension elements may be located at various distances from the face of the panel to the base, thus, adjusting the depth of the space between panels as may be architecturally specified.

In another embodiment of the present invention, an apparatus is herein provided for attaching an insulated panel to a facade. The insulated panel includes an insulation core sandwiched between an outer layer and an inner layer. Also, an edge cover between the inner and outer layers is found in such insulated panel. The apparatus includes a bracket which provides a platform positioned against the inner cover of the insulated panel, as well as an arm extending outwardly from the platform that positions between the core and the edge cover of the insulated panel. First and second connectors hold the platform to the inner cover and the arm to the edge cover, respectively. In addition, a locking element fixes the base member to the facade. Further, the bracket may be further fashioned with a flange that forms a cavity holding a reveal strip. A similar bracket adjacent one bracket further provides for support of the reveal between adjacent insulated panels. Insulating bodies may lie against the strip or be placed between adjacent panels in various configurations.

An insulated panel may also be attached to a facade using a bracket that is formed into two portions, one portion being supportive and formed of a rigid or semi rigid material such as metal. The second portion is constructed of heat insulating material to form a thermal break between the facade and the insulated panel.

In other embodiments of the invention, the bracket may be structured into three parts. One part being attached to the facade, another part being attached to the insulated panel, and a third intermediate part formed of insulating material connected to the first and second parts. Again, the bracket may further include a flange forming a cavity supporting a strip with or without insulation. In other aspects of the invention, the portion of the three part bracket connected to the insulated panel may "snap-in" to the intermediate portion formed of insulating material. A "snap-in" structure is provided for this purpose.

It may be apparent that a novel and useful apparatus for fabricating and mounting panels to a facade has been hereinabove described.

It is therefore an object of the present application to provide apparatus for fabricating and mounting a plurality of panels to a façade which results in the mounting of panels in a non-progressive manner.

Another object of the present application is to provide an apparatus for fabricating and mounting a plurality of panels to a façade that is capable of being installed quickly and efficiently by the use of a manually operated fastener.

Another object of the present application is to provide an apparatus for fabricating and mounting a plurality of panels to a façade in which the reveal between panels includes an adjustable depth or distance between the façade and the panel.

Yet another object of the present application is to provide an apparatus for fabricating and mounting a plurality of panels to a façade that is durable and reliable in operation.

Another object of the present application is to provide an apparatus for fabricating and mounting a plurality of panels to a façade that allows the installation of panels more quickly than prior art systems.

Yet another object of the present application is to provide an apparatus for fabricating and mounting a plurality of panels to a façade that provides for the creation of different reveal styles, multiple panel depth options, and can be used with panels formed of plate or composite material.

Another object of the present application is to provide an apparatus for fabricating and mounting a plurality of panels to a façade that exhibits a shape that meets strict hurricane requirements.

Yet another object of the present application is to provide an apparatus for fabricating and mounting a plurality of panels to a façade that utilizes a field extrusion or base that may be employed as a field measuring device for subsequently installed panels.

Another object of the present application is to provide an apparatus for attaching an insulated panel to a facade utilizing a bracket that is connected to the insulated panel in multiple locations and prevents panel delamination.

Another object of the present application is to provide an apparatus for attaching an insulated panel to a facade in which a supporting bracket is formed in one or more parts, one of which is formed of a thermal insulative material to provide a thermal break between the insulated panel and the facade.

Yet another object of the present application is to provide an apparatus for attaching an insulated panel to a facade in which a multiple piece bracket attached to the facade and supporting the insulated panel is either formed as a unitary member or is assembled with a "snap-in" feature.

Another object of the present application is to provide an apparatus for attaching a panel to a facade employing a bracket that fixes to the panel and prevents delamination of the panel and exposure of the panel core.

A further object of the present application is to provide an apparatus for attaching a panel to a facade that employs insulating bodies to create a thermal break between the panel and the facade.

Another object of the present application is to provide an apparatus for attaching a panel to a facade that utilizes a bracket having a cavity that supports a reveal strip and a thermal break, thus, efficiently using space and minimizing hardware cost.

The application possesses other objects and advantages, especially as concerns particular characteristics and features thereof which will become apparent as the specification continues.

Various aspects of the present application will further be apparent reviewing the following drawings of the invention.

DETAILED DESCRIPTION OF THE SEVERAL VIEWS OF THE DRAWINGS

For a better understanding of the invention references made to the following detailed description of the preferred embodiments thereof which we reference to the prior described drawings.

DETAILED DESCRIPTION OF THE PREFERRED EMBODIMENTS OF THE INVENTION

The apparatus as a whole is shown in the prior described drawings. Many aspects of the present apparatus, which are being sought for patenting, may evolve from the following detailed description of the preferred embodiments thereof which should be referenced to such prior described drawings.

Figure 1:
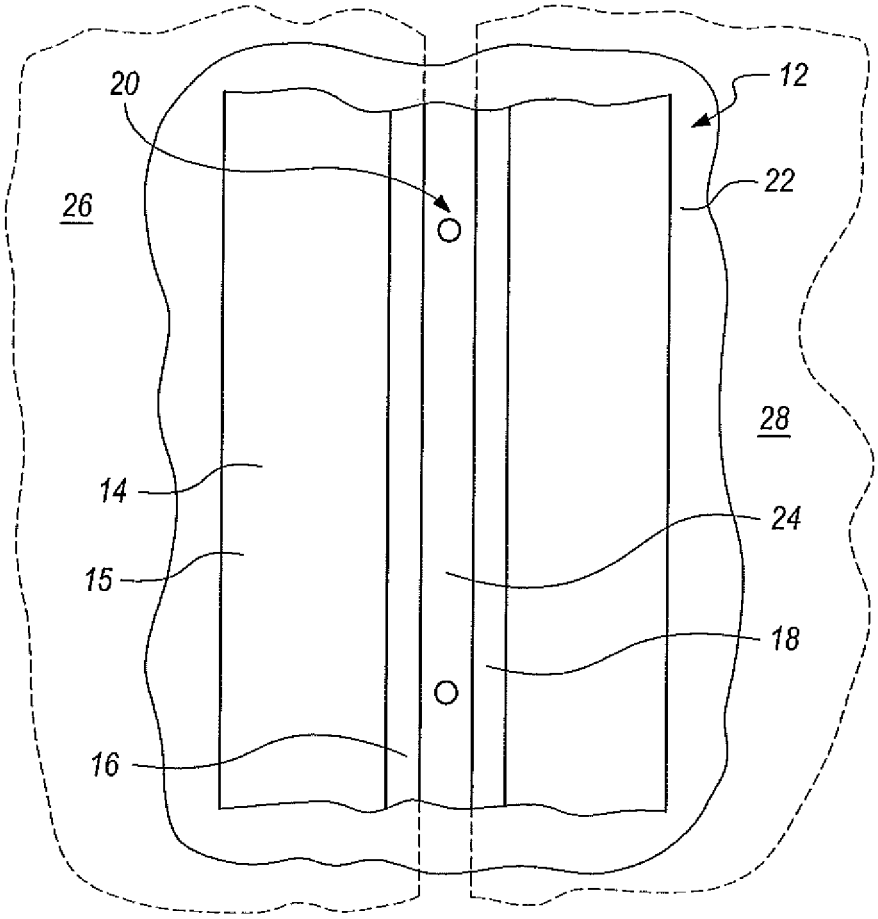
FIG. 1 is a top partial plan view of the basic element of the present invention adjacent a pair of panels.
Figure 5:
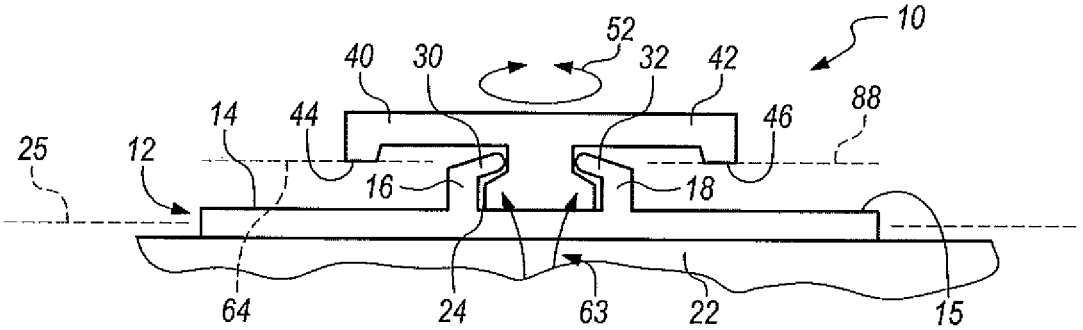
FIG. 5 is a side elevational view of the fastener and base portions of the apparatus of the present invention shown in FIG. 4.

An apparatus for mounting a plurality of panels to a façade is depicted in the drawings by reference character 10, with variation noted by the addition of an uppercase letter. Apparatus 10 includes as one of its elements a base or field extrusion 12. Base 12 possesses a plate 14, having surface 15, and first and second flanges 16 and 18 that extend outwardly from plate 14, best shown in FIGS. 1 and 5. A fixing element 20, which may take the form of a plurality of rivets, screws, and the like, holds base 12 to façade 22 which may be the side of a building or edifice. Flanges 16 and 18 form a channel 24 therebetween. In the assembled state of apparatus 10, which will be discussed in detail as the specification continues, channel 24 separates adjacent exemplary panels 26 and 28, shown in phantom on FIG. 1. Plate 14 may be positioned relative to a plane 25, FIG. 5. With further reference to FIG. 5, it may be observed that flanges 16 and 18 include resilient legs 30 and 32, respectively. Resilient legs 30 and 32 extend toward one another and toward channel 24.

Figure 2:
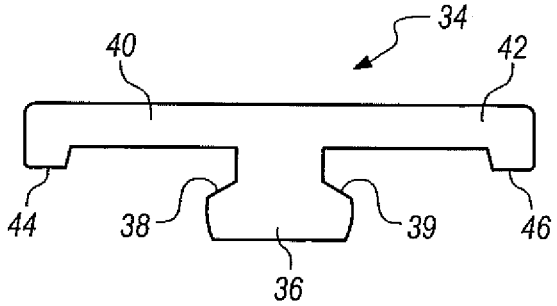
FIG. 2 is a side elevational view of the fastener employed with the apparatus of the present invention.
Figure 3:
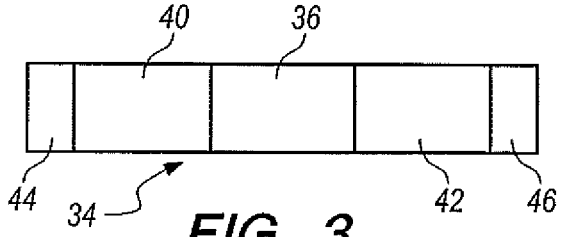
FIG. 3 is a bottom plan view of the fastener FIG. 2.
Figure 4:
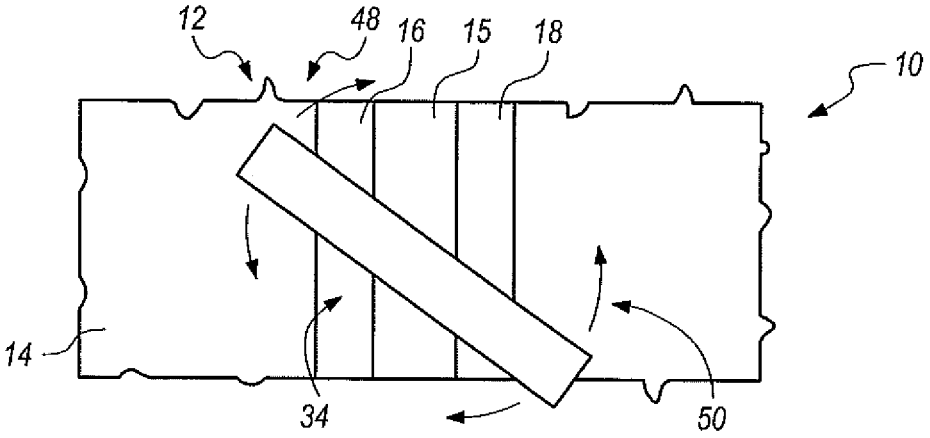
FIG. 4 is a top plan view of the fastener of FIGS. 2 and 3 being employed with the base adjacent a pair of panels.

Turning now to FIGS. 2 and 3, it may be observed that fastener 34 is depicted. Fastener 34 may be formed of any rigid or semi-rigid material, such as plastic, metal, wood, and the like. Fastener 34 includes a basal or bottom portion 36 having inclined or slanted surfaces 38 and 40. Inclined surfaces 38 and 39 are angled relative to plane 25 of plate 14 when fastener is in place in the assembled apparatus, FIG. 7, which will be detailed hereinafter. Fastener 34 is also fashioned with first and second arms 40 and 42. Arms 40 and 42 terminate in contact surfaces 44 and 46. As shown in FIGS. 4 and 5, fastener 34 is capable of rotating on surface 15 within channel 24 formed by flanges 16 and 18 extending from plate 14 of base 12 according to directional arrows 48 and 50 of FIG. 4 and directional arrow 52 of FIG. 5. Fastener 34 may also be held at channel 24 by a pop rivet, screw, rivet nut, or bolt extending through fastener 34 and plate 14.

Figure 6:
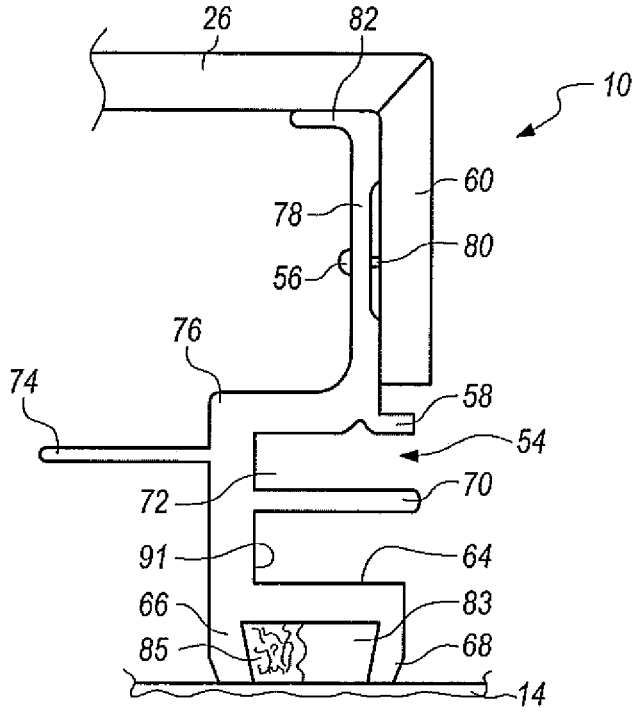
FIG. 6 is a side elevational view of an extension element used in conjunction with a single panel.

With further reference to FIG. 6 it may be seen that another part of apparatus 10 is depicted in the form of an extension element or frame extrusion 54. Extension element 54 is depicted as being connected to first panel 26 via a rivet 56. Specifically, first extension element 54 is fixed to return 60 which is either integrally formed with panel 26 or attached thereto. Return 60 may also be non-orthogonally angled relative to panel 26. First extension element 54 is similar to second extension element 62, depicted in FIG. 7, which will be discussed hereinafter. First extension element 54 includes a platform 64 supported above feet 66 and 68. Feet 66 and 68 lie on plate 14 of base 12 when apparatus 10 is assembled, FIG. 7. Cavity or space 83 between feet 66 and 68 may accept gasket material 85 (shown partially in FIG. 6) to resist water intrusion behind panels 26 and 28. Gasket material 85 will slide with exemplar extension element 54 upon the thermal expansion and contraction of panel 26. In addition, first extrusion element 54 includes a projection 70 that forms a slot 72. Moreover, a shelf 74 also extends outwardly from the body 76 of first extrusion element 54. Legs 78 of first extrusion element 54, which is shown as fixed to panel 26, forms a compression recess 80 between legs 78 and return 60. Stop 82 lies at the terminus of legs 78 and is intended to contact panel 26 to serve as a gauge to determine the distance between panel 26 and platform 64. A flange 58 projects from extrusion element 54 and may serve as a rest for a panel return longer than panel return 60. Thus, the depth between panels 24 and 26 and façade 22 may be adjusted.

Figure 7:
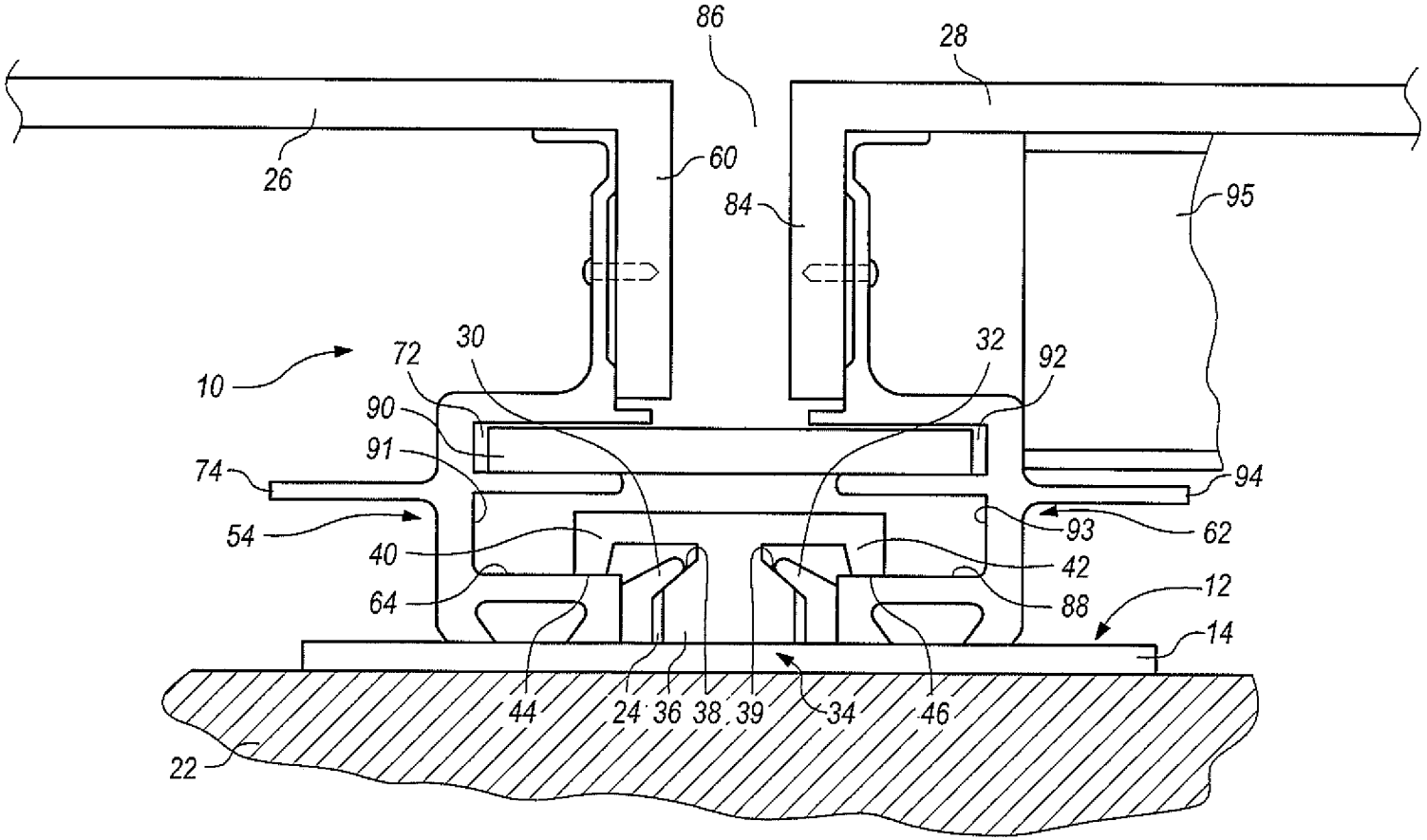
FIG. 7 is a side elevational view of a pair of panels, each having an extension element and a fastener holding such panels to the base.

Viewing now FIG. 7, it may be apparent that apparatus 10 has been assembled to hold panels 26 and 28 to façade 22. That is to say, first panel 26 having extension element 54 connected thereto has been placed on plate 14 of base 12. Likewise, panel 28 having extension element 62 attached to connected return 84 also lies atop plate 14 of base 12. Panels 26 and 28 are positioned in spaced relationship to one another such that a gap or reveal 86 is formed between returns 60 and 84 of panels 26 and 28, respectively. Fastener 34 has been rotated or twisted into place such that contact surfaces 44 and 46 of arms 40 and 42, respectively, lie over and press firmly against or position atop platform 64 of first extension element 54 and platform 88 of second extension element 62. That is to say, a slight gap may exist between contact surfaces 44 and 46 and platforms 64 and 88, respectively. In this regard, incline surfaces 38 and 39 of fastener are forced against resilient legs 30 and 32 of flanges 16 and 18 (force arrows 63) such that fastener 34 is wedged into channel 24 between flanges 16 and 18. At the same time, contact surfaces 44 and 46 press firmly against or lie over platforms 64 and 88, respectively. By this action, panels 26 and 28 are held in place on façade 22 as shown in FIG. 7. Arms 40 and 42 of fastener 34 may be lengthened from the image of FIG. 7 to lie near or against the walls 91 and 93 of extension elements 54 and 62, respectively. It should also be noted that a strip 90 has been inserted into slots 72 and 92 of first and second extension elements 54 and 62 respectively. Strip 90 serves an aesthetic purpose and is additionally employed to resist water leakage toward plate 14 of base 12. Shelf 94 of second extension element 62 is shown as supporting a stiffener 95 which contacts the underside of panel 28 and provides support thereto. Shelf 74 of first extension element may also provide accommodation for corner bracket 126, discussed hereinafter.

Figure 8:
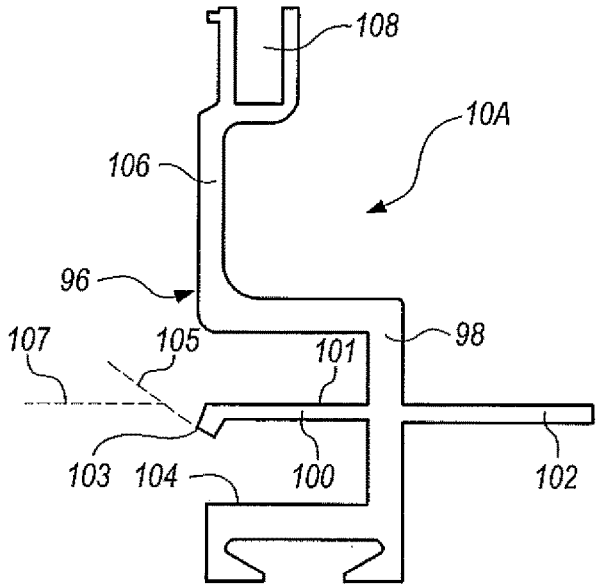
FIG. 8 is a side elevational view of another embodiment of extension element used with the apparatus of the present invention.
Figure 9:
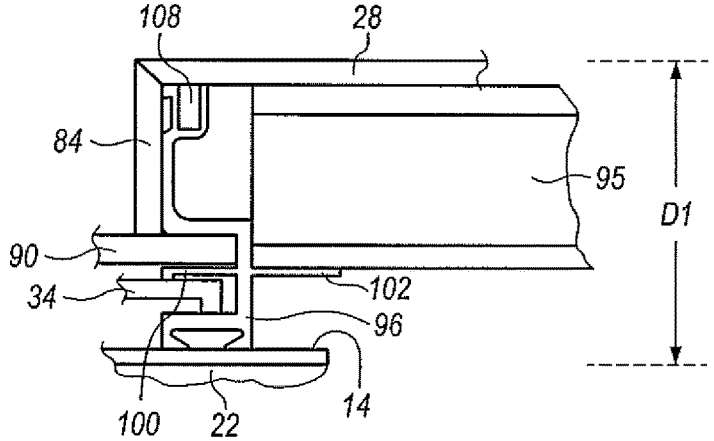
FIG. 9 is a side elevational view of the extension element of FIG. 8 used in conjunction with a single panel having a stiffener and the fastener element partially shown.
Figure 10:
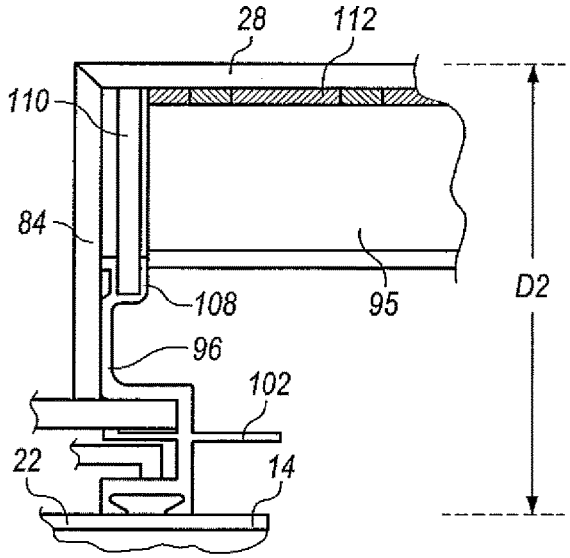
FIG. 10 is a side elevational view of the extension element of FIG. 8 employed with a filler member creating the mounting of a panel having a greater depth than shown in FIG. 9.

With further reference to FIGS. 8 through 10, another embodiment 10A of the present invention is shown with a variation of extension elements 54 and 62. Namely, extension element 96 is illustrated having a body portion 98, projection 100 with surface 101, shelf 102, and platform 104. Projection 100 includes a sloped end surface 103 that lies along a plane 105 that intersects plane 107 across surface 101. In addition, a leg 106 terminates in a notch 108. Extension element 96 is useful in adjusting the depth between the supported panel and the base fixed to the façade. For example, FIG. 9 shows panel 28 being fixed to extension element 96. Shelf 102 is used to support stiffener 95 and as an alignment for return leg 84. Shelf 102 also adds rigidity to extension element 96. Shelf 102 also gauges the size of stiffener 95, FIG. 9, as well as adding structural rigidity to extension element 96. Strip 90, fastener 34, and the similar components shown in extension element 62 are partially illustrated in FIG. 9. Projection 100 presses against strip 90 forcing strip 90 along return 84. Moisture is at least partially repelled from entry behind panel 28, by this expedient. Notch 108 rests against the underside of panel 28. Thus, the distance between the top of plate 14 and panel 28 is shown as distance "D1".

Turning to FIG. 10, it may be observed that extension element 96 has been moved downwardly toward plate 14 such that notch 108 lies a certain distance from panel 28. A filler member 110 has been placed in notch 108 between panel 28 and notch 108 in this regard. Filler member 110 serves as a gauge or measuring device during fabrication of panel 28 and return leg 60. Thus, the distance between panel 28 and plate 14 is indicated as distance "D2" which is greater than "D1" of FIG. 9. In other words, the depth or distance between panel 28 and plate 14 and façade 22 is adjustable. Notch 108 may also be filled with material to further raise panel 28. However, stiffener 95 must now be fastened to the underside of panel 28 by the use of mastic layer 112.

Stiffener 95, FIGS. 9 and 10, may be attached mechanically to shelf 102 by crimping and the like. Stiffener may also be caulked to the underside of panel 28. Such caulking ideally takes place after painting and oven curing of exemplary extension element 96 and attached stiffener 95. Again, stiffener 95, being sized to sandwich between shelf 102 and panel 28, resists twisting under exerted forces and add rigidity to panel 28.

Figure 11:
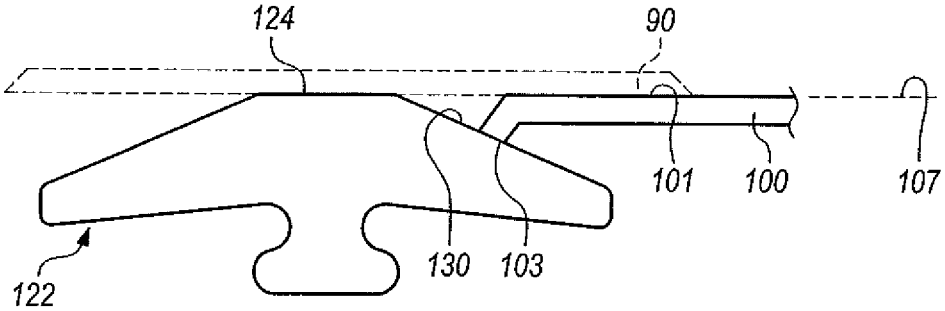
FIG. 11 is a side elevational view of an alternative embodiment of a fastener which may be employed with the extension element of FIG. 8.

Further, a fastener 122, FIG. 11, may be employed with extension element 96, in substitution for fastener 34 (FIG. 7), such that strip 90 in reveal 86 is capable of riding on the raised top surface or boundary 124 of fastener 122, and into slots 72 and 92 of extension elements 54 and 62, since surface 124 is about the same level as plane 107 of surface 101 of projection 100. It should also be seen that sloped end surface 103 rides on angled side surface 130 of fastener 124. Sloped end surface 103 may also be placed over surface 130 leaving a gap therebetween. When fastener 124 is twisted into contact with platforms 64 and 88 of extension elements 54 and 62, respectively, projection 100 presses tightly against strip 90 and the walls of slot 92, FIG. 7. Such snug fitting helps prevent water from entering beneath panel 28. Of course the same would hold true with respect to slot 72 of extension 54.

Figure 12:
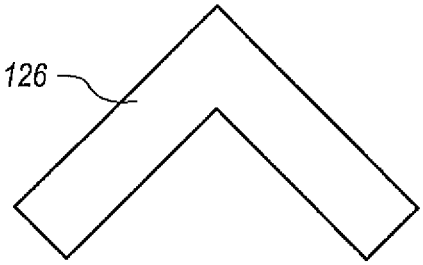
FIG. 12 is a top plan view of a corner bracket 126 used with a pair of extension elements of FIG. 8.
Figure 13:
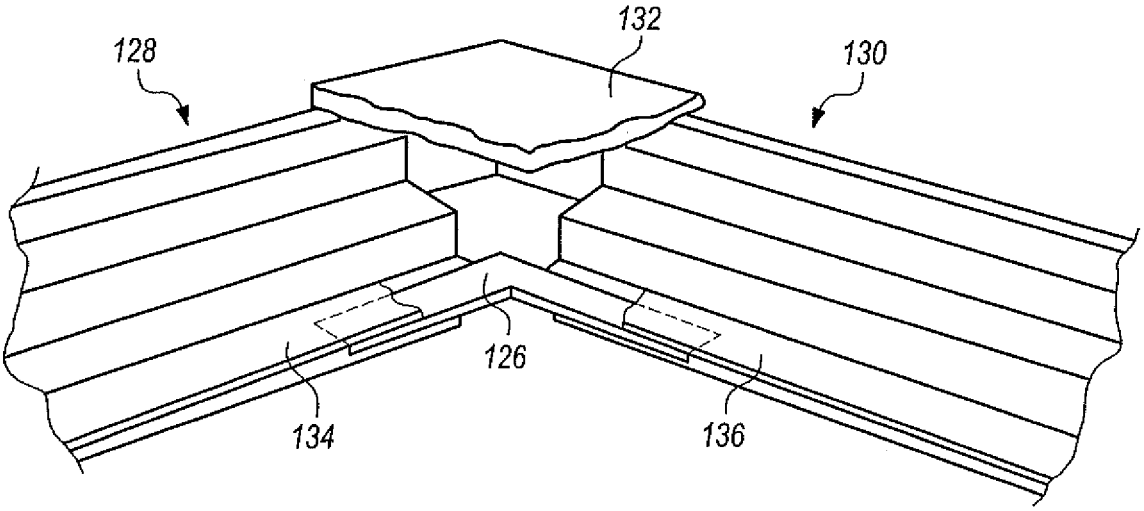
FIG. 13 is an isometric view of corner bracket 126 used with a pair of extension elements shown in FIG. 8.

Looking at FIGS. 12 and 13, a corner bracket 126, in the form of an "L" shaped member is illustrated. Corner bracket adjoins extension elements 128 and 130 below panel 132 (partially shown). Corner bracket is fixed to extension elements 128 and 130 via a mechanized fastening.

Corner bracket 126 is fastened to the underside of shelves 134 and 136 of extension elements 128 and 130, respectively, by crimping or the like. Shelves 134 and 136 are similar to shelf 102 of FIGS. 8-10. Thus, adjacent panels mounted to façade 22 are formed into a contiguous rigid frame via the use of corner brackets similar to corner bracket 126. In other words, all panels mounted to façade 22 by apparatus 10 are accurately aligned.

Figure 14:
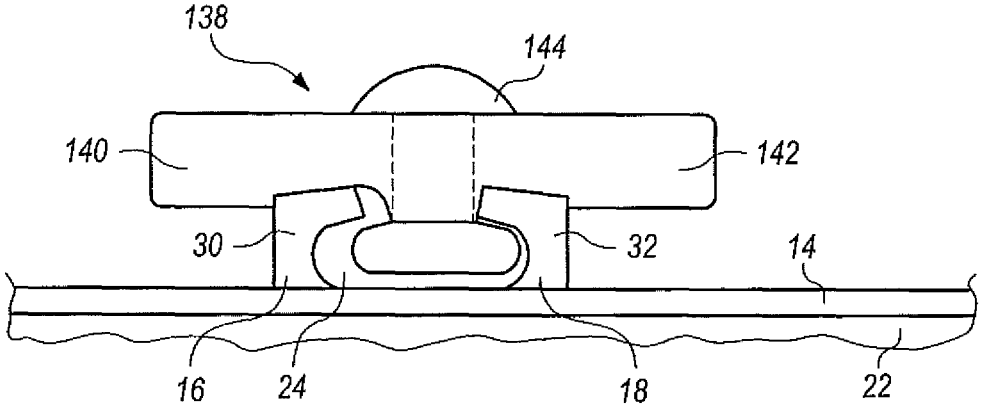
FIG. 14 is a side elevational view of another embodiment of a fastener in place on the base A.
Figure 15:
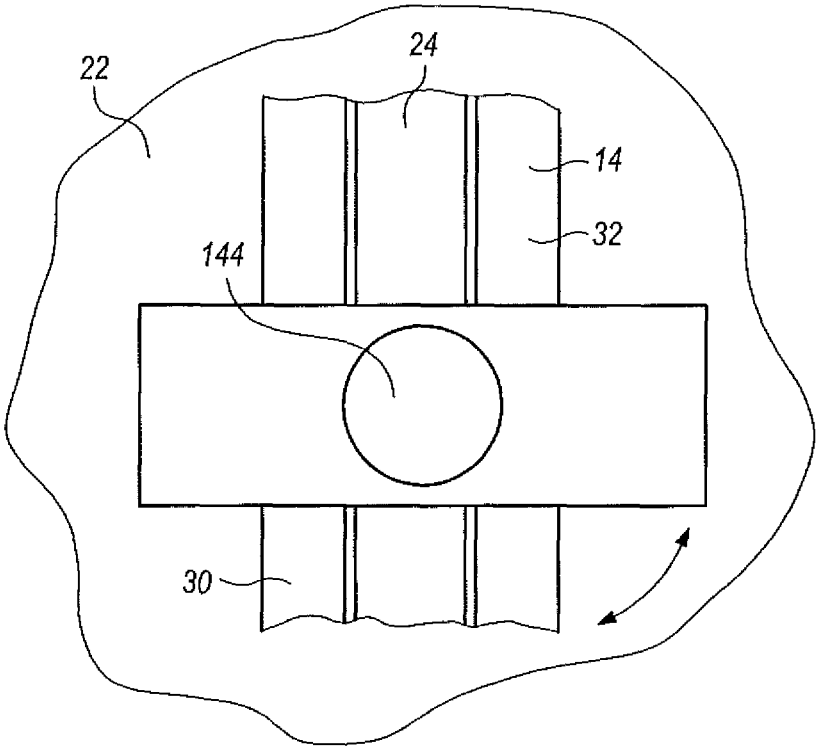
FIG. 15 is a top plan view of the elements shown in FIG. 14.

With reference to FIGS. 14 and 15, another fastener 138 is shown that may be substituted for fastener 34 or fastener 122 in apparatus 10. Fastener 34 includes arms 138 and 140 that function similarly to arms 40 and 42 of fastener 34. A shaft such as rivet 144 passes through fastener 138 and bears on resilient legs 30 and 32 of flanges 16 and 18.

In operation, panels 26 and 28 are held to façade 22 by the use of apparatus 10 namely by employment of base 12 held to façade 22 and extension elements such as extension elements 54 and 62 of FIG. 7 that are connected to panels 26 and 28 respectively. Base 12 and similar bases serve as a field measuring device for panels installed later. Fastener 34 is pressed down into channel 24 formed between flanges 16 and 18 and twisted or rotated within channel 24 such that contact surfaces 44 and 46 firmly press against platforms 64 and 88 of extension elements 54 and 62, respectively. Such pressing derives from the interaction of inclined surfaces 38 and 39 of fastener 34 against resilient flanges 30 and 32, force arrows 63. Stiffener 95 may be employed in certain cases and may be held by shelf 94 of extension element 62 or shelf 74 of extension element 54 (not shown). A reveal 86 is formed between panels 26 and 28 such that strip 90 positioned within slot 72 and 92 of extension elements 54 and 62, respectively, extends across reveal 86. With respect to use of extension elements such as extension element 96 as shown in FIGS. 8-10, the same operation applies, except that a notch 108 may be used either to support panel 28 or be positioned apart from panel 28. In the latter case, a filler member 110 may be employed in notch 108 as shown in FIG. 10. Again, stiffener 95 may be either held by shelf 102 of extension element 96 or be fastened to the underside of panel 28 by the use of mastic layer 112. Apparatus 10 permits the thermal expansion and contraction of panels 26 and 28 relative to base 12 via the use of fastener 34.

Figure 16:
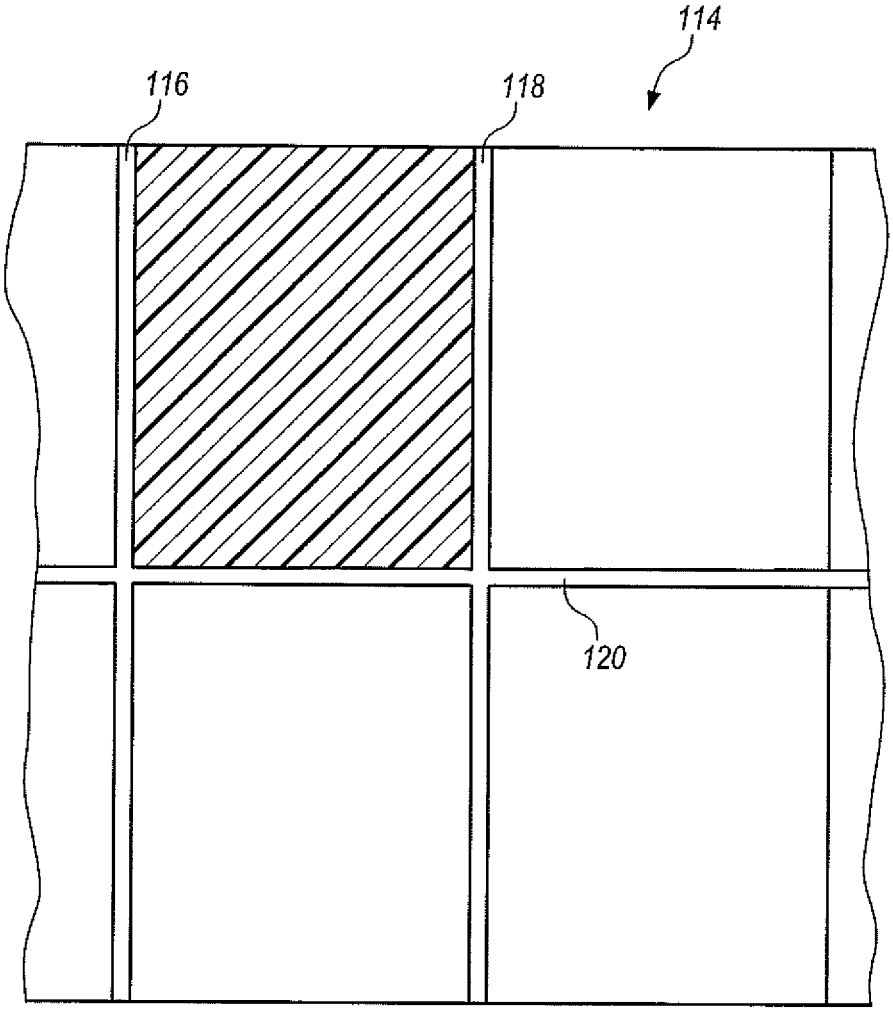
FIG. 16 is a top plan view showing a plurality of panels mounted using the apparatus of the present invention.

FIG. 16 represents a plan view showing a plurality of panels 114 mounted to a façade with reveals 116, 118, and 120 shown therein. Such panels are mounted in a non-progressive manner such that any panel of plurality of panels 114 may be removed as needed by simply by twisting or turning fastener 34 between particular panels to remove the same from the flanges of base members adjacent such plurality of panels.

Figure 17:
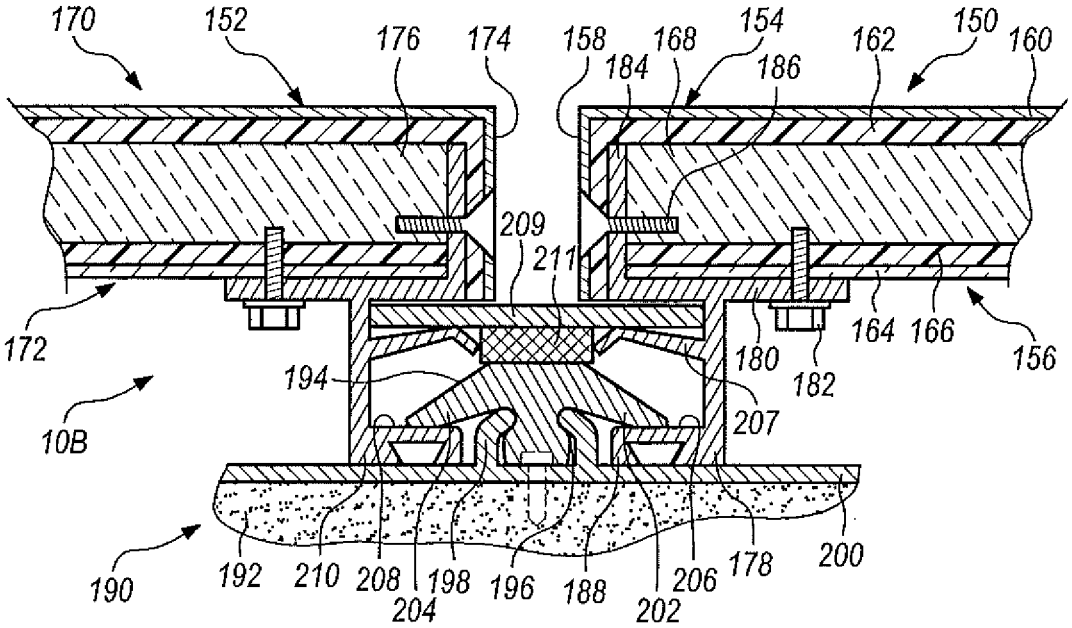
FIG. 17 is a partial sectional view of another embodiment of the application illustrating the attachment of an insulated panel to a facade.

With reference to FIG. 17, another embodiment 10B of the present application is illustrated. Apparatus 10B is employed in conjunction with building panels 150 and 152, which may take the form of insulated panels. Exemplar panel 150 is shown in the form of an insulated panel and includes an outer layer 154, an inner layer 156, and an edge cover 158. Outer layer 154 is constructed with a metallic skin 160 and an insulating ply 162, typically constructed of a plastic material such as polyethylene. Likewise, inner layer 156 is formed with a metallic skin 164 and an insulating ply 166, similarly constructed to skin 160 and ply 162 with respect to outer layer 154. Edge cover 158 is also constructed of a metallic material. Insulating ply 162 extends to the underside of edge cover 158. A core 168, generally formed of an insulating plastic material such as polystyrene, lies within outer layer 154, inner layer 156, and edge cover 158. Core 168 may be constructed of other materials where panel 150 is not an insulated panel. Needless to say, panel 152 is identically formed having outer layer 170, inner layer 172, edge cover 174, and enclosed core 176.

A bracket 178 is depicted in FIG. 17 in conjunction with insulated panel 150 and includes a platform 180 positioned against inner layer 156 of insulated panel 150. Connector 182 holds platform 180 to inner layer 156. Also, bracket 178 is provided with an arm 184 extending outwardly from platform 180 and positioned between core 168 and edge cover 158 of insulated panel 150. Connector 186 holds arm 184 to edge cover 158. First connector 182 and second connector 186 may take the form of metallic screws and the like.

With further reference to FIG. 17, bracket 178 is also formed with a base member 188. A locking element 190 fixes base member 188 to facade 192, similar to facade 22, depicted in FIG. 5. Locking element 190 is also similar to T-fastener 122, depicted in FIG. 11 and described in detail with respect to FIGS. 2-5. Needless to say, T-fastener 194 twists into place in a similar manner to T-fastener 122 against resilient flanges 196 and 198 extending outwardly from a plate 200. In this regard, arms 202 and 204 of T-fastener 194 eventually rest on surfaces 206 and 208 of bracket 178 and a similar bracket 210, respectively, used in conjunction with insulated panel 152. Locking element of conventional configuration may also be employed with brackets 178 and 210. It should also be realized that bracket 178 is formed of a heat insulating material while bracket 210 is formed of a metallic material as examples of possible construction. In most cases, however, both brackets 178 and 210 would be formed of the same material to prevent delamination of panels 150 and 152. Plate 200 is again fastened to facade 192 by any type of fastener, such as screws, glue, welding, and the like. Bracket 178 is also shown with a flange 207 that supports a reveal strip 209 and an insulating body 211 adjacent reveal strip 209. Bracket 210 includes a similar structure.

Figure 18:
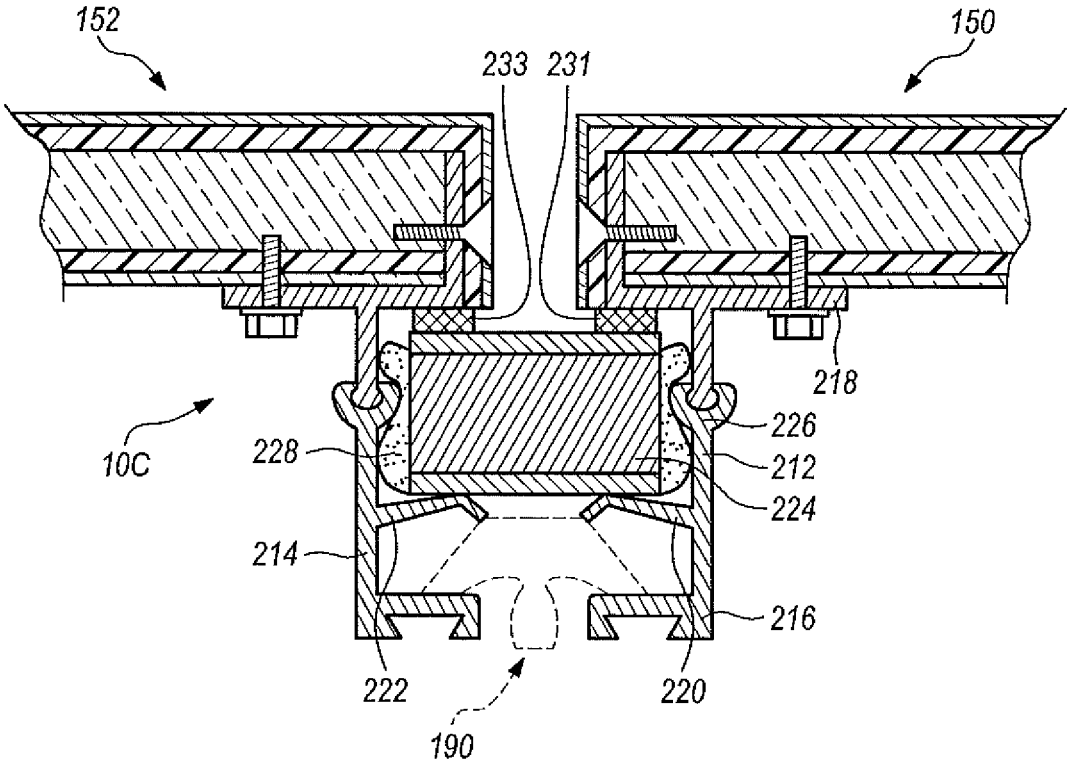
FIG. 18 is a partial sectional view of yet another embodiment of the present application for attaching an insulated panel to a facade and providing a thermal break therebetween.

Viewing now FIG. 18, another embodiment 10C of the apparatus of the present application is shown. Brackets 212 and 214 are shown in conjunction with insulated panels 150 and 152. Exemplar bracket 212 is similarly constructed to bracket 214, which will not be further discussed in detail. Bracket 212 is formed with a first portion 216 and a second portion 218 interconnected to first portion 216. First portion 216 is formed of a metallic material while second portion 218 is shown as being formed of a heat insulating material. The interconnection of second portion 218 of bracket 212 to insulated panel 150 is identical to that shown with respect to the interconnection of bracket 178 to panel 150 in FIG. 17. Thus, a thermal break is formed by the use or brackets 212 and 214 with respect to panels 150 and 152. In addition, locking element 190 is similar to locking element 190, shown in FIG. 17, and is only illustrated partially in phantom for the sake of clarity. Flanges 220 and 222 support insulating body 224, which may be formed of any suitable insulating material such as polystyrene. Insulated foam backing material masses 226 and 228 interpose insulated strip 224 and brackets 212 and 214, respectively. In addition, gaskets 230 and 232 lie between brackets 212 and insulative strip 224 and bracket 214 and insulated strip 224, respectively.

Figure 19:
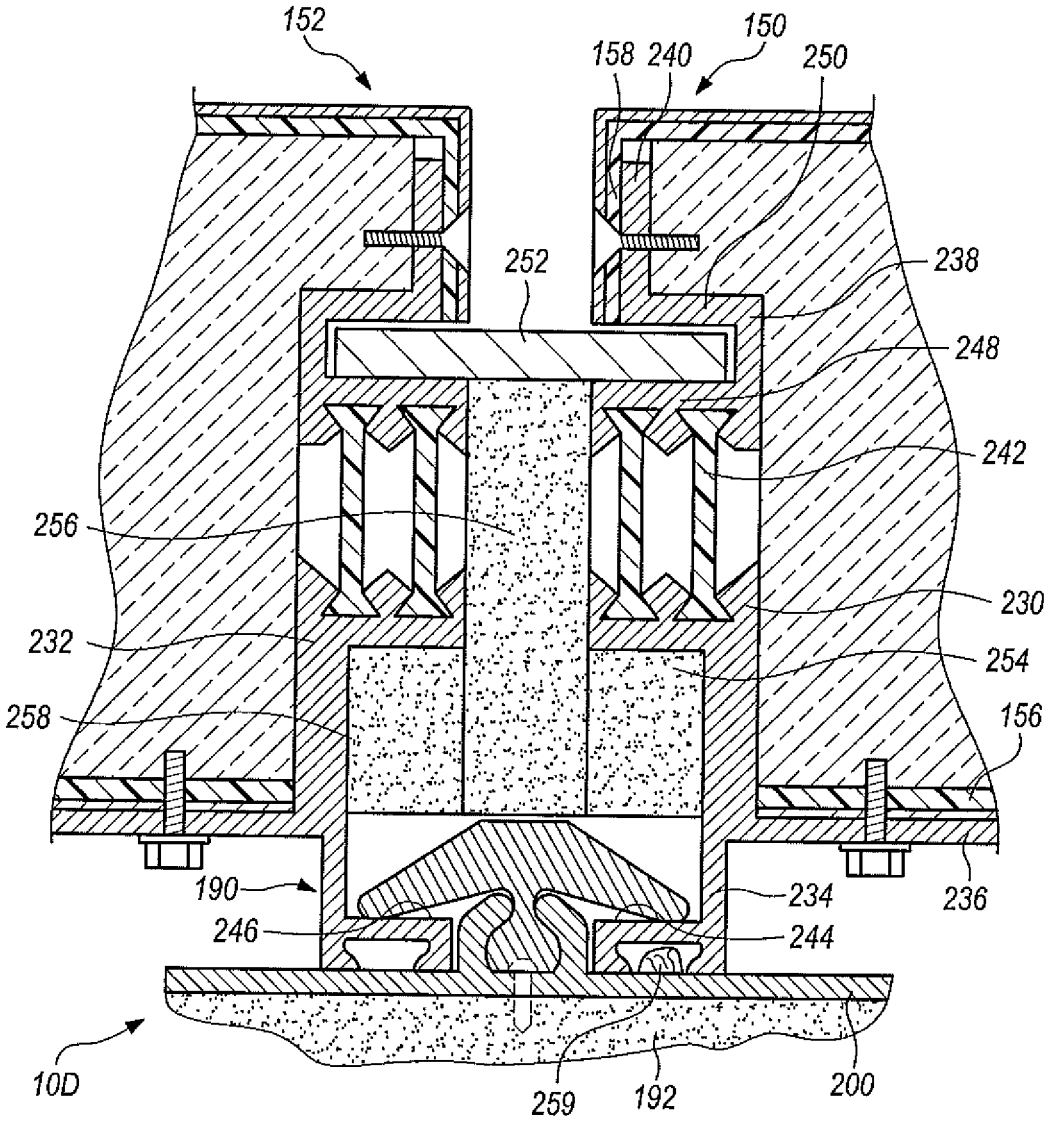
FIG. 19 is a partial sectional view of another embodiment of the present application in which supporting brackets for attaching an insulated panel to a facade are shown in three parts.

Looking at FIG. 19, it may be seen that another embodiment 10D of the present application is shown. Again, locking element 190 is illustrated and will not be further described as locking element 190 is similar to that depicted in FIG. 17. However, brackets 230 and 232 are depicted, and are similarly constructed to one another. Bracket 230 is used in conjunction with panel 150 while bracket 232 is used in conjunction with panel 152. Exemplar bracket 230 is formed with a first portion 234 constructed of metallic material. First portion 234 includes a platform 236, positioned against inner layer 156 of panel 150. A bracket 232 also possesses a second portion 238 formed of a rigid or semi rigid material such as metal. Arm 240 of second portion 238 of bracket 230 is fastened to edge cover 158 of panel 150. Most notably, an intermediate portion 242 of bracket 230 is connected to first portion 234 and second portion 238. Intermediate portion 242 may be fashioned as a plurality of elongated members formed of insulated material, as shown in FIG. 19. Thus, intermediate portion 242 serves as a thermal break between first portion 234 and second portion 238 of bracket 230. Again, locking element 190, similarly constructed to locking element 190 of FIG. 17, holds first portion 234 of bracket 230 to plate 200 via contact surface 244 of bracket 230. In addition, locking element 190 holds contact surface 246 associated with similarly constructed bracket 232, in the same manner. A flange 248 of second portion 238 creates a cavity 250 that accommodates reveal strip 252. Needless to say, bracket 232 provides a similar structure in support of reveal strip 252. To further provide a thermal break between panels 150 and 152 and facade 192, closed cell backer rods 254, 256, and 258 are employed between brackets 230 and 232. Adhesives may be used to attach backer rods 254, 256, and 258 to brackets 230 and 232. Also, other surfaces of brackets 230 and 232 may be employed for attachment of backer rods 254, 256, and 258. A stopper 259 may also be found on base plate 200. Stopper 259 steadies bracket 238 biasing the thermal expansion movement of panels 150 and 152 in one direction.

Figure 20:
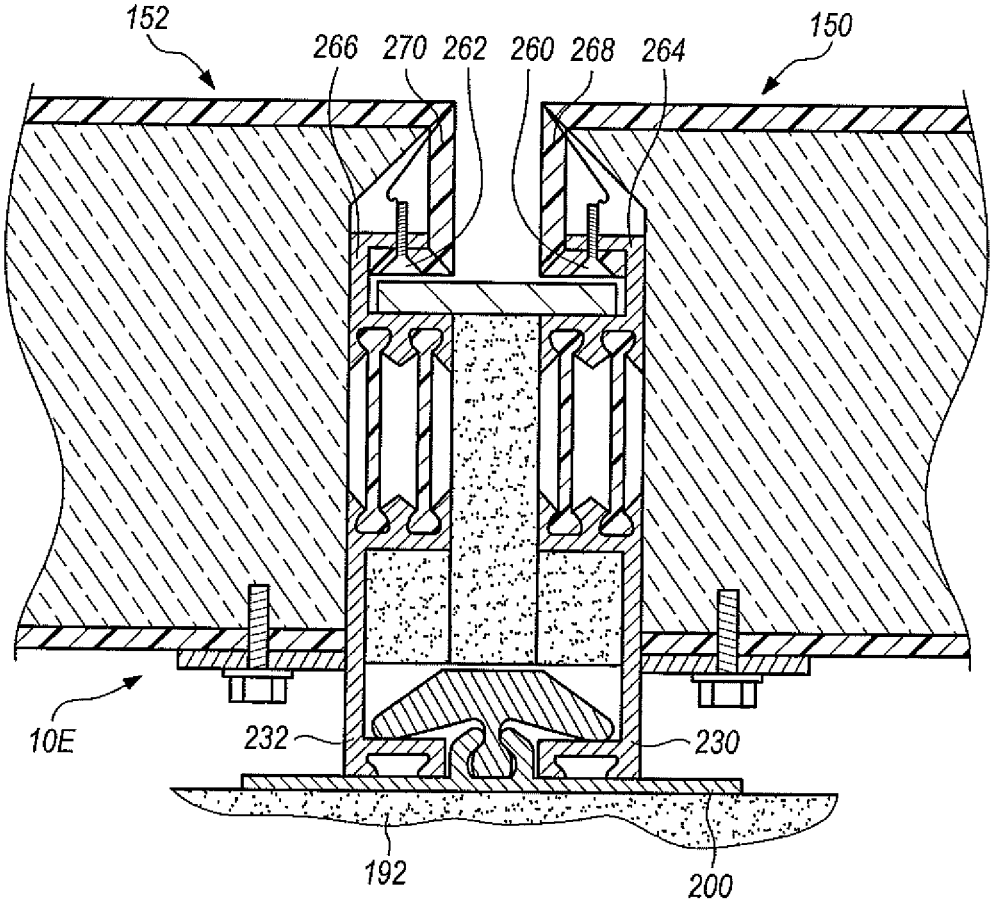
FIG. 20 represents another embodiment of the present application in which an insulated panel bracket is illustrated for attaching the same to a facade.

FIG. 20 illustrates an alteration with respect to FIG. 19, in which a pair of fasteners 260 and 262 are used to interconnect arms 264 and 266 of brackets 230 and 232 to a flap of edge covers 268 and 270. Thus, fasteners 260 and 262 are not exposed to the exterior of panels 150 and 152.

Figure 21:
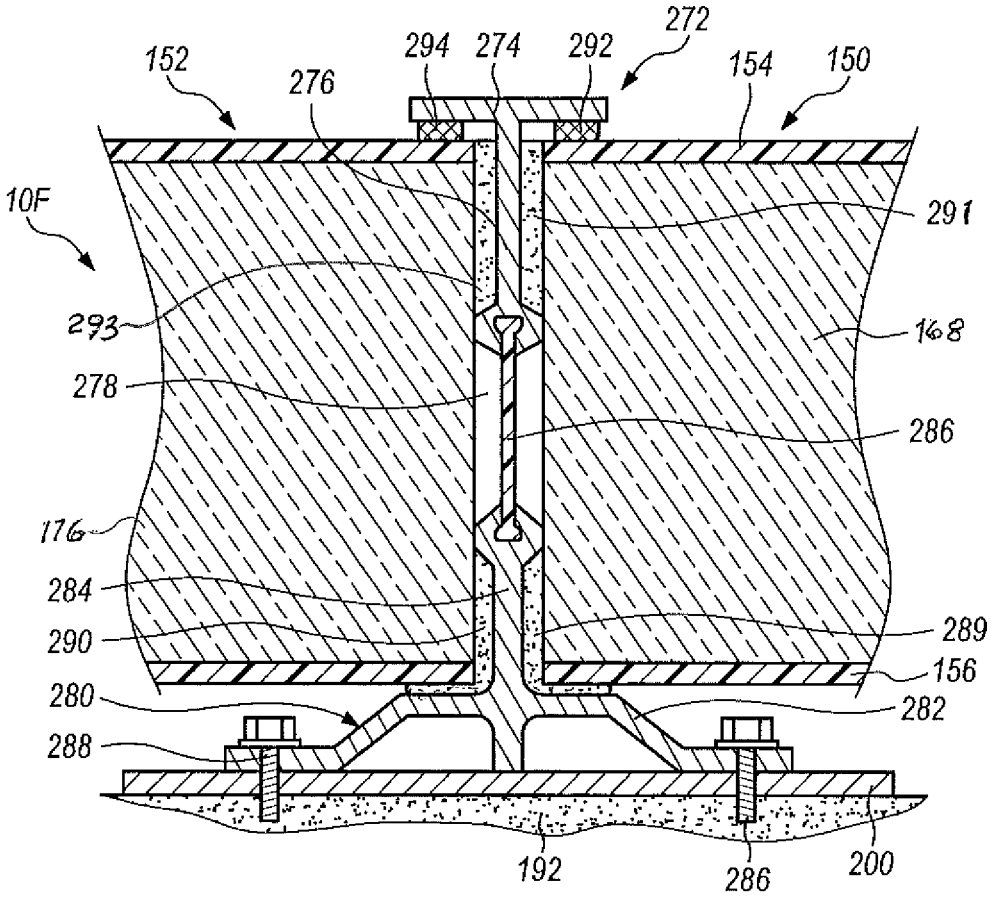
FIG. 21 is another embodiment of the present application in which a device is shown for attaching an insulated panel to a facade.

Viewing now FIG. 21, a device 272 is employed to hold panels 150 and 152 to facade 192. Device 272 includes a body 274 which bears or presses upon panels 150 and 152. A shaft 276 extends from body 274 and extends into space 278 between panels 150 and 152. A stand 280 possesses a base 282 as well as a projection or branch 284 that extends into space 278. Fasteners 286 and 288 hold stand base 282 to facade 192 via plate 200. Heat or thermal insulating element 286 interconnects shaft 276 to projection 284 within space 278, again forming a thermal break between the exterior portion of panels 150 and 152 and facade 192. Insulating foam masses 289, 290, 291, 292, 293, and 294 further provide heat insulation between the exterior of panels 150 and 152 and facade 192.

Figure 22:
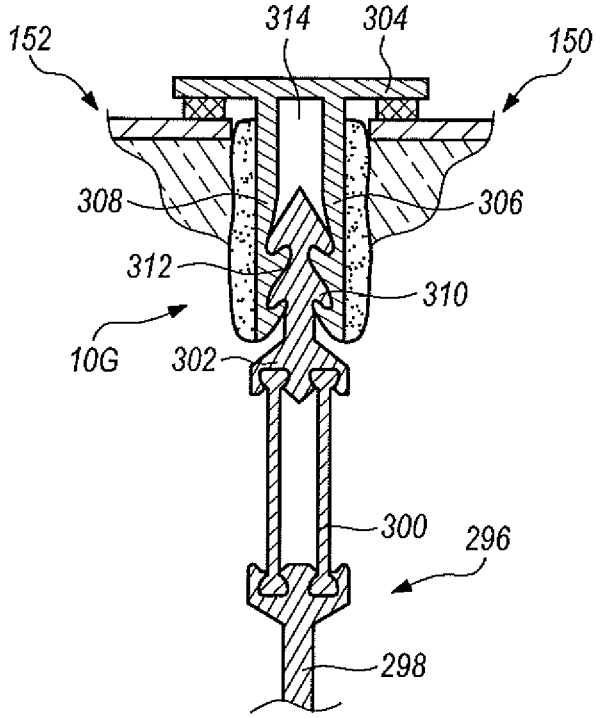
FIG. 22 is a partial sectional view of another embodiment of the present application showing a bracket used to support insulated panels to a facade in which a "snap-in" feature is shown for such bracket.

FIG. 22 represents a "snap-in" feature which may be employed to interconnect two of the three portions shown with respect to a device similar to device 272 of FIG. 21. For example, bracket 296 includes a first portion 298, a second portion 302, and an intermediate heat insulated portion 300. A body 304 bearing on the outer portions of heat insulative panels 150 and 152 is formed with a pair of legs 306 and 308. The end of second portion 302 is formed with a series of projections 310 that interact with the series of resilient projections 312 found on legs 306 and 308 extending from bearing body 304. Thus, a force exerted on second portion 302 will cause the same to enter space 314 between legs 306 and 308 and cause engagement between series of projections 310 of second portion 302 and series of resilient projections 312 of legs 306 and 308.

Figure 23:
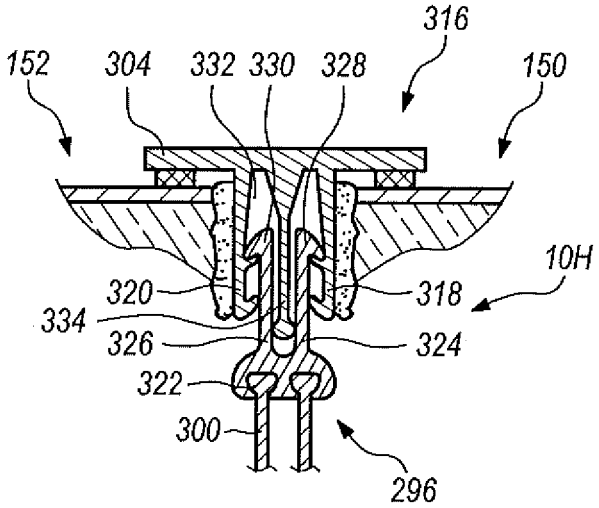
FIG. 23 is another embodiment of the present invention showing a "snap-in" feature for a bracket used for attaching an insulated panel to a facade.

Embodiment 10H of FIG. 23 shows a variation of the "snap-in" feature shown in FIG. 22 in which a body 316 pressing on the outer portions of insulated panels 150 and 152 is provided with legs 318 and 320. Second portion 322 of bracket 296 is also formed with a pair of resilient legs 324 and 326 that include enlarged end portions 328 and 330. Such enlarged end portions 328, 330 engage projections from legs 318 and 320 when pushed into space 332 between legs 318 and 320. A pendant 334 extends and snugly lies between legs 324 and 320. Thus, another "snap-in" feature has been shown.

While in the forgoing embodiments of the present invention have been set forth in considerable detail for the purposes of making a complete disclosure of the invention, it may be apparent to those of skill of the art that numerous changes may be made without departing from the spirit and principles of the invention.

What is claimed is:

1. A device for attaching adjacent first and second insulated panels to a facade, each insulated panel including an outer layer and an inner layer and the first and second insulated panels being separated from one another to form a space therebetween, comprising: a body bearing on said outer layer of said first and second insulated panels;

a shaft extending from said body and extending to the space between said first and second insulated panels;

a stand, said stand having a base and a leg extending into said space between said first and second insulated panels;

an anchor, said anchor holding said base to the facade; a heat insulating element connected to said shaft and said leg, said heat insulating element positioned in said space between said first and second insulated panels;

a first core of insulating material located between said outer and inner layers of said first insulated panel;

a second core of insulating material located between said outer and inner layers of said second insulated panel;

a first insulating mass positioned between said body and said outer layer of said first insulated panel;

a second insulating mass positioned between said body and said outer layer of said second insulated panel;

a third insulating mass positioned between said base and said inner layer of said first insulated panel;

a fourth insulating mass positioned between said base and said inner layer of said second insulated panel; and said heat insulating element, first core of insulating material, second core of insulating material, first insulating mass, second insulating mass, third insulating mass, and fourth insulating mass forming a thermal break between said outer layers of said first and second panels and said facade.

2. The device of claim 1 further comprising:

a pair of legs extending from said body into said space between said first and second insulated panels, said pair of legs each further comprising a projection;

said device comprising a first portion lying apart from said body and said pair of legs, a second portion, said second portion including a plurality of projections, said plurality of projections of said second portion being configured to interact with said projection on each of said pair of legs; and said heat insulating element lying intermediate said first and second portions, said first portion, said second portion, and said heat insulated element forming a bracket to hold said first and second insulated panels.

3. The device of claim 2 in which said projection on each of said pair of legs comprises a resilient projection.

4. The device of claim 2 in which said second portion comprises a pair of enlarged end portions configured to engage said projection on each of said pair of legs extending from said body, said shaft further comprising a pendant lying between said pair of legs extending from said body.

* * * * *